United States Patent [19]

Pinson

[11] Patent Number: 4,625,646

[45] Date of Patent: Dec. 2, 1986

[54] AERIAL MISSILE HAVING MULTIPLE SUBMISSILES WITH INDIVIDUAL CONTROL OF SUBMISSIBLE EJECTION

[75] Inventor: George T. Pinson, Huntsville, Ala.

[73] Assignee: The Boeing Aerospace Company, Seattle, Wash.

[21] Appl. No.: 194,040

[22] Filed: Oct. 6, 1980

[51] Int. Cl.[4] ..... F42B 13/50; F42B 25/16

[52] U.S. Cl. ..... 102/489; 102/393

[58] Field of Search ..... 102/489, 393, 394, 351, 102/505

[56] References Cited

U.S. PATENT DOCUMENTS 3,308,719 3/1967 Myers ..... 102/394

3,712,229 1/1973 Schock ..... 102/489

4,172,407 10/1979 Wentink ..... 102/489

*Primary Examiner*—Charles T. Jordan

*Attorney, Agent, or Firm*—Thomas H. Murray

[57] ABSTRACT

An aerial missile carrying multiple launching tubes for submissiles in a circular locus about the longitudinal axis of the aerial missile has independent activating means for each said launching tube to pivot the rear discharge end of each launching tube radially outwardly from the aerial missile. Means for ejecting the individual submissile rearwardly from the launching tube are provided. In one embodiment, a single gas generator activates the launching tube and ejects the submissile. Multiple pyrotechnic charges are provided in one embodiment to establish the ejection velocity of the submissile.

12 Claims, 14 Drawing Figures

AERIAL MISSILE HAVING MULTIPLE SUBMISSILES WITH INDIVIDUAL CONTROL OF SUBMISSIBLE EJECTION

BACKGROUND OF THE INVENTION

1. Field of the Invention

This invention relates to an aerial missile containing multiple submissiles which can be individually ejected from the aerial missile in a direction which is generally opposite to the path of the missile.

2. Description of the Prior Art

Aerial missiles containing multiple submissiles are described in copending U.S. patent application Ser. No. 107,023, filed Dec. 26, 1979, now U.S. Pat. No. 4,372,216. Therein the aerial missile includes multiple launch tubes, each containing a submissile which can be ejected in a direction opposite to the path of the aerial missile. The launch tubes function in groups concurrently to discharge a volley of submissiles in response to a common actuator. The flexibility of the aerial missile could be greatly increased if the submissiles could be individually launched from the aerial missile without need to activate an entire group of launch tubes. The flexibility of the aerial missile could be further increased if the individual submissiles could be discharged at selected ejection velocities.

SUMMARY OF THE INVENTION

According to the present invention, an aerial missile having multiple submissile launching tubes is provided wherein each of the submissile launching tubes is individually operable and is secured to the aerial missile by a mounting means which permits pivotal movement from an inactive position wherein the launching tube is generally parallel to the longitudinal axis of the aerial missile into an activated position wherein the rear portion of the launching tube is pivoted outwardly away from the aerial missile. According to the present invention appropriate power operated means are provided to accomplish the pivoting movement of each launching tube into its activated position. The power operated means are secured at one end to a structural component of the aerial missile and are secured at the other end to the launching tube at a location which is remote from the pivotal mounting means. The power operated means may be a cylinder and piston with gas generating means to advance the piston within the cylinder. In a preferred embodiment, a structural restraint is provided to limit the pivotal movement of the launching tube in its activated position. In a further embodiment, the gas generating means for activating each launching tube is a pyrotechnic charge. In a still further embodiment, the gas generating means has sufficient gas to pivot the launching tube and also to eject a submissile from the launching tube. In a still further embodiment, a gas generating means is mounted within each launching tube.

In another embodiment, the gas generating means includes multiple pyrotechnic charges and means for activating one or more of the pyrotechnic charges to establish the ejection velocity of the submissile from the launching tube. In a still further embodiment, a single gas generating means is provided for more than one of the launching tubes.

BRIEF DESCRIPTION OF THE DRAWINGS

FIG. 2 particularly shows a portion of an aerial missile with the submissile launching tubes in normal retracted position. FIG. 3 shows the same portion of an aerial missile with the launching tubes in the submissile ejection position.

DESCRIPTION OF THE PREFERRED EMBODIMENTS

Figure 1:
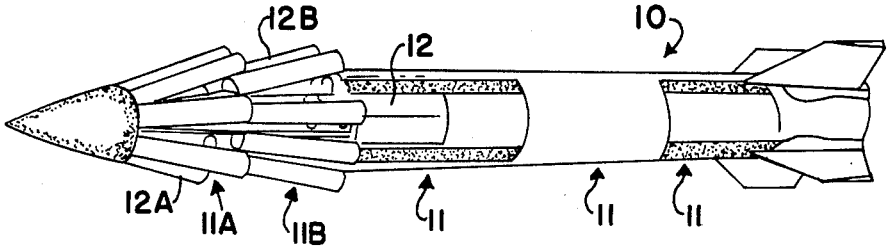
PRIOR ART FIG. 1
FIGS. 1, 2 and 3 are perspective sketches of a prior art aerial missile having multiple launching tubes for carrying and rearwardly ejecting submissiles.
Figure 2:
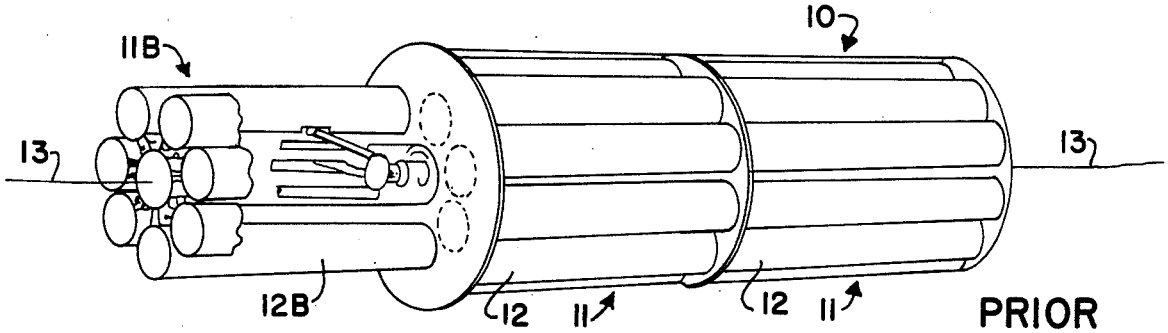
PRIOR ART FIG. 2

An aerial missile 10 is illustrated in FIG. 1 corresponding to that described in copending U.S. patent application Ser. No. 107,023, supra. The aerial missile 10 contains multiple groups 11 of launching tubes 12. The two forward groups 11*a*, 11*b* have their launching tubes 12*a*, 12*b* pivoted outwardly for rearward ejection of submissiles which are contained within those tubes. The operation of the rearward discharge missiles is more clearly illustrated in FIGS. 2 and 3. The launching tubes 12*b* of the group 11*b*, in their normal flight position, FIG. 2, are aligned essentially parallel with the longitudinal axis 13 of the aerial missile 10. According to the prior art, the entire group 11*b* of launching tubes 12*b* can be activated by means of a power source 14 which pivots the launching tubes 12*b* about a forward pivotal mounting 15 for each of the tubes 12*b*. Preferably, each of the launching tubes 12*b* has a shield surface 16 which is a cylindrical fragment, as shown in FIG. 3

Figure 3:
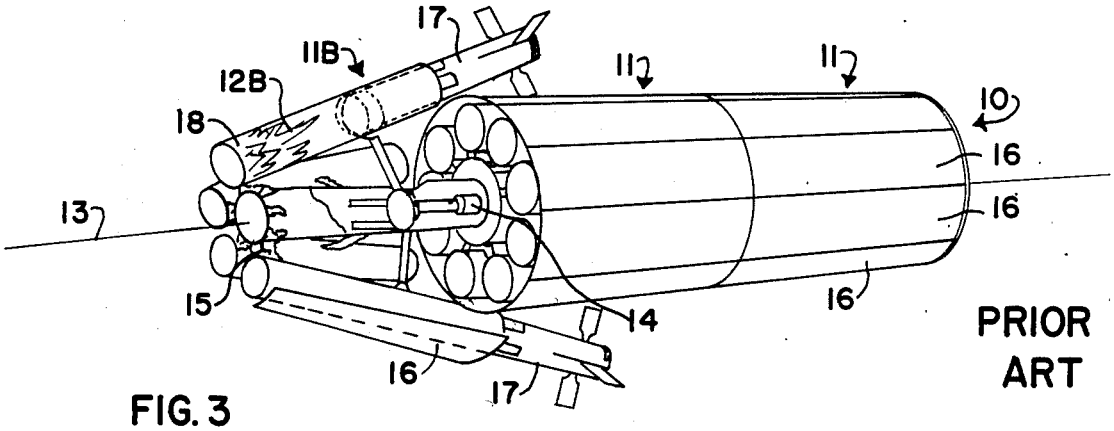
PRIOR ART FIG. 3

When the launching tubes 12*b* are in the activated position, FIG. 3, a submissile 17 is rearwardly ejected from the launching tube 12*b* by means of a pyrotechnic charge schematically illustrated in detonation at 18. The submissiles 17 are ejected from the aerial missile 10 and assume independent flight toward a target.

Figure 4:
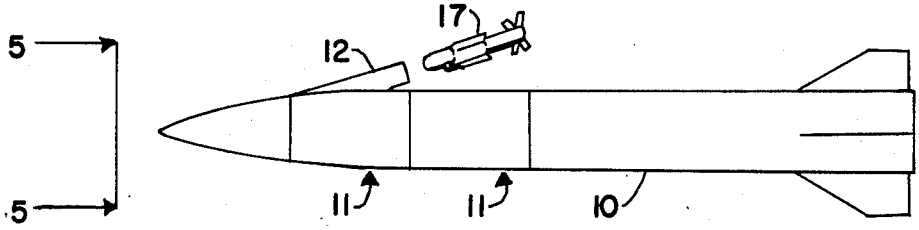
FIG. 4 is an elevation view of an aerial missile of the present invention having a single submissile launching tube in the submissile ejection position.
Figure 5:
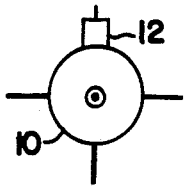
FIG. 5 is a front view of the aerial missile of FIG. 4 taken along the lines 5—5 of FIG. 4.

According to the present invention, FIGS. 4 and 5, the flexibility of the aerial missile 10 can be greatly increased if the aerial missile has the ability to activate less than a complete group 11 of launching tubes 12 and to eject submissiles 17 independently.

Figure 6:
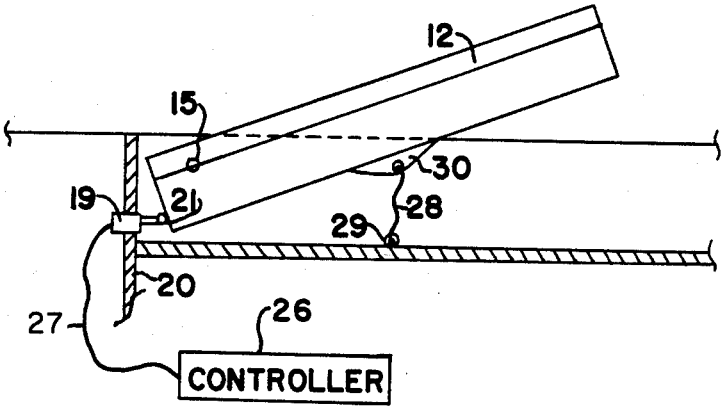
FIG. 6 is a schematic illustration of one embodiment of the mounting means for the submissile launching tubes of this invention.
Figure 8:
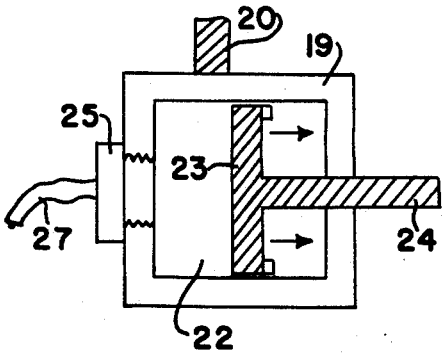
FIG. 8 is a schematic illustration of a pyrotechnicoperated piston and cylinder power means.

According to the present invention, as shown in FIG. 6, this result can be achieved by providing for each launching tube 12 a forward pivotal mounting means 15 and a power operated means 19 which is secured at one end to a structural component 20 of the aerial missile and is secured at the other end to the launching tube 12 at a location 21 which is remote from the pivotal mounting 15. A typical power operated means 19 is illustrated in FIG. 8 including a cylinder chamber 22 in which a piston 23 is slideably positioned and connected to a piston arm 24. The power operated means 19 is secured to the structural component 20. A gas generator 25 communicates with the cylinder chamber 22 and supplies pressurized gases when activated by an appropriate signal delivered from a controller 26 (FIG. 6) through wiring or tubing 27. The piston 23 advances and forces the piston arm 24 against the securing location 21 whereby the launching tube 12 pivots outwardly away from the aerial missile to permit ejection of a single submissile. Some restraining means is provided, schematically indicated in FIG. 6 as a cable 28 which is connected at one end to a bracket 29 which is connected to the structural component 20 and connected at the other end to a bracket 30 which is secured to the launching tube 12 remote from the forward pivotal mounting 15.

Figure 7:
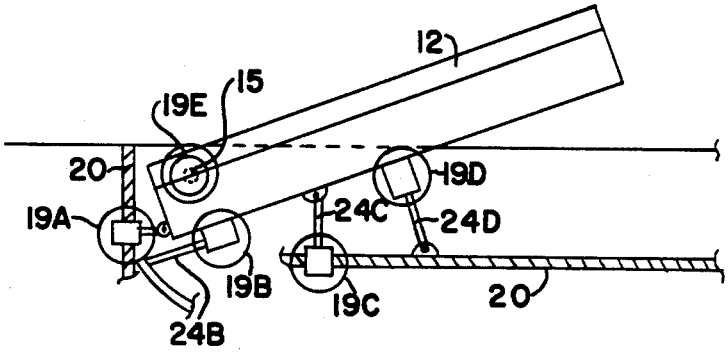
FIG. 7 is a composite schematic illustration showing several types of power means for activating a launching tube of this invention.
Figure 9:
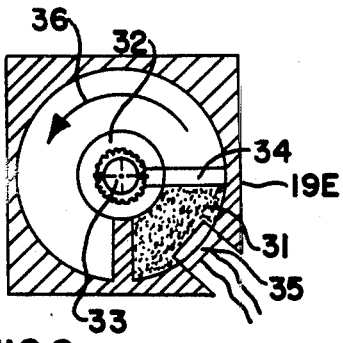
FIG. 9 is a schematic illustration of a rotary piston and cylinder power means for activating a launching tube.

Several alternative embodiments of the power operated means 19 are illustrated in FIG. 7. The means 19*a* corresponds to that already illustrated in FIG. 6. The means 19*b* is secured to the launching tube 12 and the piston arm 24*b* is pivotally connected to the structural component 20. The power operated means 19*c* is similar to 19*a* except that the piston arm 24*c* is connected to the launching tube 12 along the peripheral lengthwise surface of the launching tube. The power operated means 19*d* is secured to the peripheral wall of the launching tube 12 and the piston arm 24*d* is secured to the structural component 20 of the aerial missile. A circular power operated means 19*e* is more fully illustrated in FIG. 9 wherein an expansion chamber 31 is an annular space about a cylindrical shaft 32 which is geared to a shaft 33 which is fixed with respect to the aerial missile. An annular piston 34 is secured to the cylindrical shaft 32. When a gas generator 35 is activated, the gas pressure increases in the expansion chamber 31 causing the annular piston 34 and the shaft 32 to rotate about the fixed shaft 33 in the direction indicated by the arrow 36. The launching tube (not shown in FIG. 9) is secured to the shaft 32 and is caused to pivot in the direction shown by the arrow 36 about the fixed shaft 33.

Submissile Ejection

Figure 10:
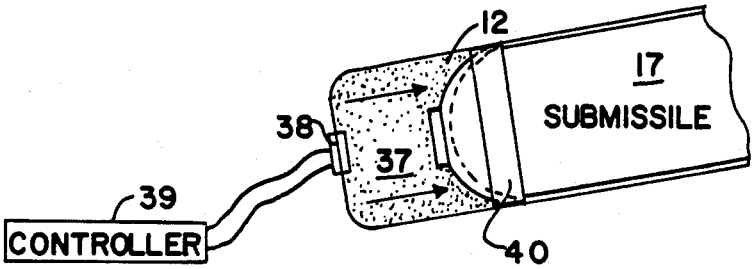
FIG. 10 is a schematic illustration of a launching tube containing a submissile at the incipient moment of ejection.

FIG. 10 shows a submissile 17 mounted within a launching tube 12. Immediately following activation of the launching tube 12 into a pivoted position, the submissile 17 is energetically ejected rearwardly by means of a pyrotechnic charge 37 which is detonated by means of an appropriate initiator 38 under the influence of a controller 39. An appropriate sabot 40 fills the bore of the launching tube 12 and centers the submissile 17 throughout the ejection. The sabot 40 separates from the submissile 17 when the independent flight of the submissile 17 commences. It will be observed that the pyrotechnic charge 37 is contained within the launching tube 12.

Figure 11:
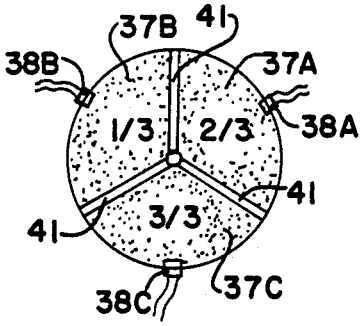
FIG. 11 is a schematic illustration of a segmented pyrotechnic charge which permits control of the ejection velocity of a submissile from a launching tube.

A further improvement in the present invention is shown in FIG. 11 where the pyrotechnic charge 37 is provided in multiple cylindrical segments 37*a*, 37*b*, 37*c*, each of which is provided with its own initiator 38*a*, 38*b*, 38*c*, respectively. The charges 37*a*, 37*b*, 37*c* are of sufficient size that any one of the charges is adequate to expel a submissile from a launching tube. By using more than one of the charges 37*a*, 37*b*, 37*c* simultaneously or sequentially, the ejection velocity of the submissile can be increased. The charges 37*a*, 37*b*, 37*c* are separated by separator walls 41.

Figure 12:
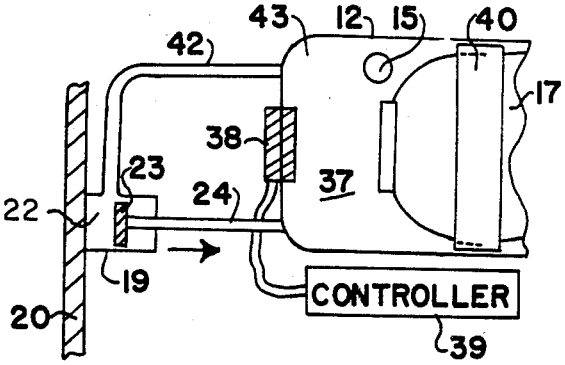
FIGS. 12 and 13 are schematic illustrations of alternative embodiments of the invention for activating a launching tube and launching a submissile.

In a further embodiment of this invention, a single power operated means may be employed to activate the launching tube by pivotal movement away from the aerial missile and also to eject the submissile within the launching tube. In FIG. 12, the launching tube 12 contains a submissile 17 and a sabot 40. A power operated means 19, secured to a structural component 20 of the aerial missile, includes a cylinder chamber 22, a piston 23 and a piston arm 24 which is secured to the launching tube 12 at a location which is remote from a forward pivotal mounting 15. A connecting conduit 42 communicates between the cylinder chamber 22 and the forward chamber 43 of the launching tube 12. A pyrotechnic charge 37 is provided within the launching tube 12. An appropriate initiator 38 is provided for initiating the pyrotechnic charge 37 under the influence of a controller 39. The sequence of operations of the structure illustrated in FIG. 12 is that the initiator 38 ignites the pyrotechnic charge 37 which causes an increase in the gas pressure within the chamber 43. The increase in pressure is communicated through the conduit 42 into the cylinder chamber 22 causing the piston 23 and piston arm 24 to advance whereby the launching tube is activated by pivotal movement about the forward pivotal mounting 15. The increased gas pressure within the chamber 43 forces the sabot 40 and submissile 17 rearwardly for ejection from the launching tube 12.

Figure 13:
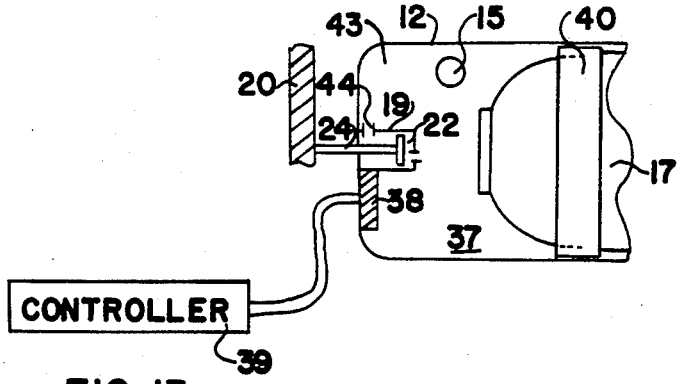

A further embodiment of the combined launching tube activation and submissile ejection is illustrated in FIG. 13 where a power operated means 19 is mounted within the forward chamber 43 of the launching tube 12. The forward chamber 43 contains a pyrotechnic charge 37. A piston arm 24 engages a structural component 20 of the aerial missile. Because of the relatively short piston stroke which is available in this embodiment, the power operated means 19 is deployed at a short distance away from the forward pivotal mounting 15. An initiator 38, controlled by a controller 39, initiates the pyrotechnic charge 37 in the forward chamber 43. The increased pressure in the cylinder chamber 22 causes the piston arm 24 to extend and causes the launching tube 12 to pivot outwardly about the forward pivotal mounting 15. Concurrently the pyrotechnic charge 37 forces the sabot 40 and submissile 17 rearwardly from the launching tube 12.

A common advantage of the embodiments of FIGS. 12 and 13 is that any pressurized gases which are employed in operating the system will be released instantaneously from the system as the submissile 17 is ejected. The launching tube 12 will automatically return to its normal in-flight position, i.e., essentially parallel to the longitudinal axis of the aerial missile.

Figure 14:
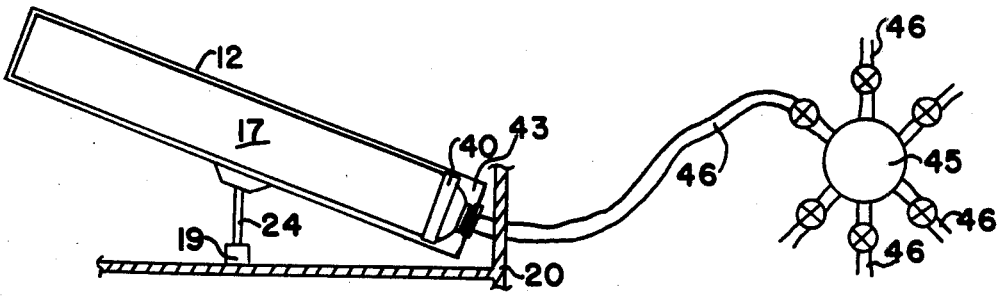
FIG. 14 is a schematic illustration of a gas generator system for use in launching multiple submissiles.

FIG. 14 illustrates a still further embodiment of the present invention wherein a common gas generator 45 communicates through a plurality of valved conduits 46, each of which is connected to a separate one of the launching tubes 12. In operation, the launching tube 12 is activated by the power operated means 19 and the piston arm 24. The submissile 17 is ejected by means of pressurized gases delivered from the gas generator 45 through the appropriate valved conduit 46 into the forward chamber 43 against the sabot 40.

I claim:

1. In an aerial missile having multiple, rearward discharge launching tubes for submissiles, said launching tubes arranged in a cylindrical locus about the longitudinal axis of said aerial missile, improved activating means for each said launching tube comprising:

a mounting means for securing each launching tube to said aerial missile to permit pivotal movement from an inactive position generally parallel to the said longitudinal axis of the aerial missile to an activated position wherein the rear portion of the launching tube is displaced radially outwardly from the aerial missile;

independent power operated means for pivoting each launching tube to the said activated position, said power operated means secured at one end to a structural component of said aerial missile and secured at the other end to said launching tube remote from said mounting means.

2. The improvement of claim 1 wherein said power operated means comprises an expansion chamber and piston and a gas generating means to advance the said piston within the said expansion chamber and thereby to increase the length of said power operated means and to pivot the said launching tube.

3. The improvement of claim 1 wherein restraint means is secured at one end to the structural frame of the said aerial missile and secured at the other end to the said launching tube at a point which is remote from the said mounting means.

4. The improvement of claim 2 wherein said gas generating means is a pyrotechnic charge.

5. The improvement of claim 2 wherein the said gas generating means communicates with the said launching tube and supplies sufficient gas to extend the said power operated means and also to eject a submissile from the launching tube.

6. The improvement of claim 5 wherein the said gas generating means is mounted within the launching tube.

7. The improvement of claim 1 wherein the said power operated means includes a expansion chamber positioned annularly of the said mounting means and wherein one wall of said expansion chamber is secured to the said launching tube and is rotatably secured to the said mounting means whereby increased pressure within the said expansion chamber causes the said one wall to advance in a cylindrical locus about the said mounting means and thereby to pivot the said launching tube.

8. The improvement of claim 1 wherein a separate gas generating means is provided for ejecting a submissile from the launching tube by increasing the gas pressure in the forward portion of the launching tube until the gas pressure blows the submissile rearwardly from the launching tube.

9. The improvement of claim 8 wherein said separate gas generating means is provided for each said launching tube.

10. The improvement of claim 9 wherein the said separate gas generating means is mounted within the forward portion of each launching tube.

11. The improvement of claim 10 wherein each said separate gas generating means has multiple pyrotechnic charges, and means for activating one or more of the said multiple pyrotechnic charges within the said launching tube to establish the ejection velocity of the submissile from the launching tube.

12. The improvement of claim 8 wherein one gas generating means is provided for multiple launching tubes and conduit means connect the said one gas generating means to each of the said multiple launching tubes and gas flow control means are provided for each of said conduit means.

* * * * *